US005682763A

United States Patent [19]

Agrawal et al.

[11] Patent Number: 5,682,763

[45] Date of Patent: Nov. 4, 1997

[54] ULTRA HIGH PURITY OXYGEN DISTILLATION UNIT INTEGRATED WITH ULTRA HIGH PURITY NITROGEN PURIFIER

[75] Inventors: Rakesh Agrawal, Emmaus; Zbigniew Tadeusz Fidkowski, Macungie; Lawrence Walter Pruneski, Schnecksville, all of Pa.

[73] Assignee: Air Products and Chemicals, Inc., Allentown, Pa.

[21] Appl. No.: 738,989

[22] Filed: Oct. 25, 1996

[51] Int. Cl.[6] ..... F25J 1/00

[52] U.S. Cl. ..... 62/643; 62/913

[58] Field of Search ..... 62/643, 913

[56] References Cited

U.S. PATENT DOCUMENTS

| | | | |
|---|---|---|---|
| 3,363,427 | 1/1968 | Blanchard et al. . | |
| 4,560,397 | 12/1985 | Cheung . | |
| 4,615,716 | 10/1986 | Cormier et al. . | |
| 4,617,040 | 10/1986 | Yoshino | 62/913 |
| 4,780,118 | 10/1988 | Cheung . | |
| 4,867,772 | 9/1989 | Eyre . | |
| 4,869,741 | 9/1989 | McGuinness et al. . | |
| 4,977,746 | 12/1990 | Grenier et al. . | |
| 5,049,173 | 9/1991 | Cormier, Sr. et al. . | |
| 5,060,480 | 10/1991 | Saulnier | 62/606 |
| 5,084,081 | 1/1992 | Rohde | 62/656 |
| 5,195,324 | 3/1993 | Cheung . | |
| 5,355,680 | 10/1994 | Darredeau et al. | 62/656 |
| 5,408,831 | 4/1995 | Guillard et al. | 62/913 |

FOREIGN PATENT DOCUMENTS 2 640 032 6/1990 France .

*Primary Examiner*—Ronald C. Capossela
*Attorney, Agent, or Firm*—Willard Jones, II

[57] ABSTRACT

A method for producing ultra high purity liquid oxygen from standard grade liquid oxygen which integrates the oxygen purification process with a nitrogen purification process by utilizing the condensing duty of liquid nitrogen, thereby causing the nitrogen to vaporize which is desirable prior to delivery to a nitrogen purification unit. The method of the present invention includes pressurizing a source of liquid nitrogen and vaporizing at least a portion of the pressurized liquid nitrogen. The resulting high pressure gaseous nitrogen stream is introduced to at least one bottom reboiler/condenser of a high purity liquid oxygen unit, which also purifies standard grade liquid oxygen into ultra high purity liquid oxygen. The gaseous nitrogen provides the needed heat to the distillation columns of the high purity liquid oxygen unit. The condensed nitrogen is subsequently delivered to at least one top reboiler/condenser of the high purity liquid oxygen unit to provide refrigeration to the unit, and at the same time forming gaseous nitrogen which is then introduced to a nitrogen purification unit. The following streams are withdrawn from the unit: (a) ultra high purity liquid oxygen; (b) an argon-enriched waste stream; (c) a hydrocarbon-enriched waste stream. The oxygen purification portion of the method of the present invention can be accomplished on a portable skid, which includes primarily tanks, distillation columns, and heat exchangers, but no pumps or compressors.

12 Claims, 9 Drawing Sheets

ULTRA HIGH PURITY OXYGEN DISTILLATION UNIT INTEGRATED WITH ULTRA HIGH PURITY NITROGEN PURIFIER

BACKGROUND OF THE INVENTION

The present invention pertains to the production of ultra high purity liquid oxygen from standard grade liquid oxygen.

Liquefied atmospheric gases, e.g., oxygen, nitrogen, argon, etc., are increasingly used in industry, providing cryogenic capabilities for a variety of industrial processes. There is an increasing demand for ultra high purity gases, especially in the electronics industry. Frequently, the time period needed to build a new ultra high purity gas plant for the electronics industry is undesirably long. Therefore, there is a need for a preassembled, portable "skid," defined as a preassembled, portable system, capable of being easily integrated with a relatively larger system and capable of producing ultra high purity gases with a reasonable efficiency.

There are several known processes for producing ultra high purity oxygen. Several processes are directed to producing ultra high purity oxygen (and sometimes also nitrogen) by cryogenic rectification of air, not by purification of standard grade oxygen. For example, U.S. Pat. Nos. 4,560,397; 4,615,716; 4,977,746; 5,049,173; and 5,195,324 disclose these types of processes. Production of ultra high purity liquid oxygen by direct rectification of air consumes less energy than production of standard grade liquid oxygen and subsequent distillation of standard grade liquid oxygen to ultra high purity liquid oxygen.

In some circumstances, ultra high purity oxygen is produced by distillation of standard grade liquid oxygen. For example, U.S. Pat. No. 3,363,427 discloses a process for purifying a standard grade oxygen. This process is carried out in a single distillation column at atmospheric pressure. U.S. Pat. No. 4,780,118 and French Patent Application No. 2,640,032 disclose cryogenic processes for the production of ultra high purity oxygen from standard grade oxygen. According to the disclosures of these references, the distillation columns are configured in the "direct sequence," in which argon is removed as a top product of the first column and the remaining mixture is separated in the second column into ultra high purity oxygen and a hydrocarbon-enriched waste stream. On the other hand, U.S. Pat. No. 4,867,772 discloses the same process except in the "indirect sequence," in which all of the heavy impurities (e.g., hydrocarbons) are removed at the bottom of the first column, and the remaining mixture of argon and oxygen is separated in the second column.

In U.S. Pat. No. 4,869,741, a process for producing ultra high purity oxygen is described. This process utilizes a system of distillation columns including a main column and a side stripper. Reboil and reflux ratio are controlled by nitrogen recycle. This system requires that a recycle compressor and the associated heat exchanger be used, which leads to a complex flow sheet with a substantial energy consumption.

FIG. 1 is a schematic diagram of a process representative of the '741 patent in which ultra high purity liquid oxygen is obtained from standard grade liquid oxygen. This process includes several energy consumers. For example, a heat exchanger 18 is used to warm low pressure gaseous nitrogen in line 17 to near ambient temperature. The warmed gaseous nitrogen is then compressed to a higher pressure in recycle compressor 19. This stream is then cooled with cooling water in heat exchanger 20 and subsequently in the recycle heat exchanger 18 to result in stream in line 9. The pressure in the recycle compressor discharge system is chosen such that the pressure of stream in line 9 is the correct pressure for the nitrogen to condense in reboiler/condensers 12 and 13 while maintaining the required temperature differences across the condensing and boiling fluid passages.

When ultra high purity nitrogen is produced from standard grade liquid nitrogen using catalytic methods, the energy of evaporation is normally supplied either by ambient heat, water, steam, or electricity. In FIG. 2, a conventional ambient liquid nitrogen vaporizer is shown. In this process, standard grade liquid nitrogen in line 10 is pressurized to an appropriate pressure to form pressurized liquid nitrogen in line 20, vaporized to form gaseous nitrogen in line 30, and introduced to a catalytic purifier (i.e., nitrogen purification unit 54) to remove oxygen and carbon monoxide, resulting in ultra high purity nitrogen in line 40. The potential condensing duty of liquid nitrogen is not utilized.

BRIEF SUMMARY OF THE INVENTION

The present invention is directed to a method for producing ultra high purity liquid oxygen from standard grade liquid oxygen while utilizing the condensing duty of liquid nitrogen, which must be evaporated prior to delivery to a purifier. Thus, the potential condensing duty of liquid nitrogen is not lost, but instead is used to drive the ultra high purity liquid oxygen distillation process. The present invention also provides for a portable skid, on which the ultra high purity oxygen system can be placed and which can be coupled with the system for producing ultra high purity gaseous nitrogen. The portable skid includes tanks, distillation columns, and heat exchangers, and does not include any pumps or compressors.

In the method of the present invention, a source of liquid nitrogen is pressurized and at least a portion of this liquid nitrogen is vaporized to form a high pressure gaseous nitrogen stream. The high pressure gaseous nitrogen stream is introduced to at least one bottom reboiler/condenser of a high purity liquid oxygen unit to provide heat to the unit and to form a nitrogen condensate stream. Standard grade liquid oxygen is also introduced to the high purity liquid oxygen unit for purification into ultra high purity liquid oxygen. The nitrogen condensate stream is introduced to at least one top reboiler/condenser of the high purity liquid oxygen unit to provide condensing duty (i.e., refrigeration) to the unit and to form a reduced pressure gaseous nitrogen stream, which is delivered to a nitrogen purification unit for purification into ultra high purity gaseous nitrogen. The following streams are withdrawn from the high purity liquid oxygen unit: (a) ultra high purity liquid oxygen; (b) an argon-enriched waste stream; and (c) a hydrocarbon-enriched waste stream.

According to a preferred embodiment of the present invention, only a portion of the liquid nitrogen (from the initial source of liquid nitrogen) is vaporized. The remaining portion of the liquid nitrogen is combined with the nitrogen condensate to form a combined stream, which is introduced to a top reboiler/condenser(s) of the high purity liquid oxygen unit.

The high purity liquid oxygen unit includes at least one distillation column and may be configured in any of several known configurations. The high purity liquid oxygen unit must be capable of separating a hydrocarbon-enriched waste stream and an argon-enriched waste stream from standard grade liquid oxygen to produce ultra high purity liquid oxygen.

It is to be understood that both the foregoing general description and the following detailed description are exemplary, but are not restrictive, of the invention.

BRIEF DESCRIPTION OF THE SEVERAL VIEWS OF THE DRAWINGS

The invention is best understood from the following detailed description when read in connection with the accompanying drawings.

DETAILED DESCRIPTION OF THE INVENTION

The present invention pertains to a method for producing ultra high purity liquid oxygen from standard grade liquid oxygen in a high purity liquid oxygen unit, by utilizing the condensing duty provided by liquid nitrogen in a liquid nitrogen purification process. Standard grade liquid oxygen contains about 99.5 mole percent of oxygen, 0.5 mole percent of argon (which is more volatile than oxygen), and a trace amount (about 40 ppm) of hydrocarbons (which are less volatile than oxygen). Any known sequence of distillation columns which is suitable for separating this ternary mixture can be used with the present invention. A listing of some distillation column sequences for separating a ternary mixture can be found in Separation Processes, C. J. King, McGraw-Hill Book Co., New York 1980, page 711.

Figure 3:
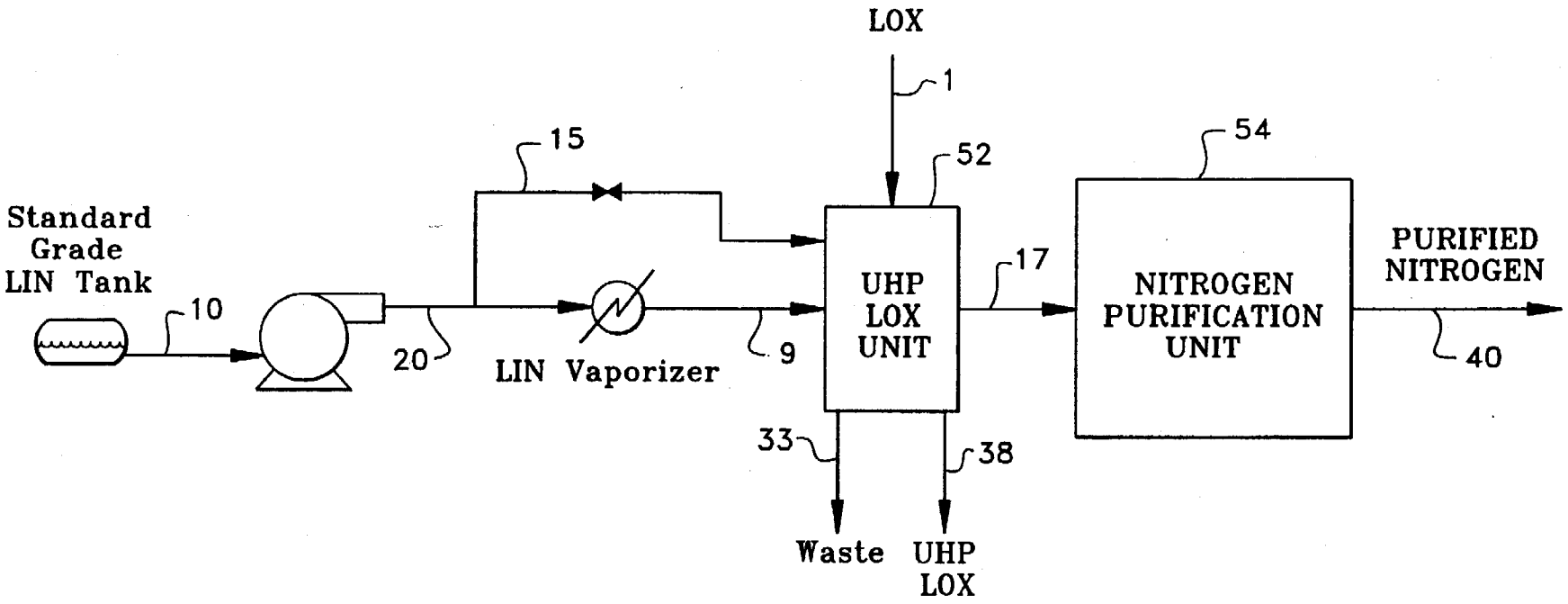
FIG. 3 is a general schematic diagram of the process of the present invention.

Referring now to the drawing, wherein like reference numerals refer to like elements throughout, FIG. 3 shows a general schematic of the present invention, with the details of various embodiments of the high purity liquid oxygen unit 52 displayed in FIGS. 4–9. As shown in FIG. 3, a source of liquid nitrogen is pressurized to a pressure which is higher than the pressure at which purified nitrogen is needed for delivery to a nitrogen purification unit. Specifically, liquid nitrogen stream in line 10 is pressurized by a pump resulting in a high pressurize liquid nitrogen stream in line 20. At least a portion of stream in line 20 is vaporized to form a high pressure gaseous nitrogen stream in line 9 which is delivered to high purity liquid oxygen unit 52. Optionally, not all of the liquid nitrogen stream in line 20 is vaporized, and the remaining portion, liquid nitrogen stream in line 15, is introduced to high purity liquid oxygen unit 52, at a different location, to provide some refrigeration. The ratio of liquid nitrogen to gaseous nitrogen delivered to high purity liquid oxygen unit 52 will depend on the level of heat leak to high purity liquid oxygen unit 52. With a greater heat leak, the more condensing duty would be required, so a relatively greater amount of liquid nitrogen would be needed. The streams withdrawn from high purity liquid oxygen unit 52 include at least one waste stream in line 33 (including hydrocarbons and argon) and an ultra high purity liquid oxygen product stream in line 38 (as shown in FIG. 3).

Figure 2:
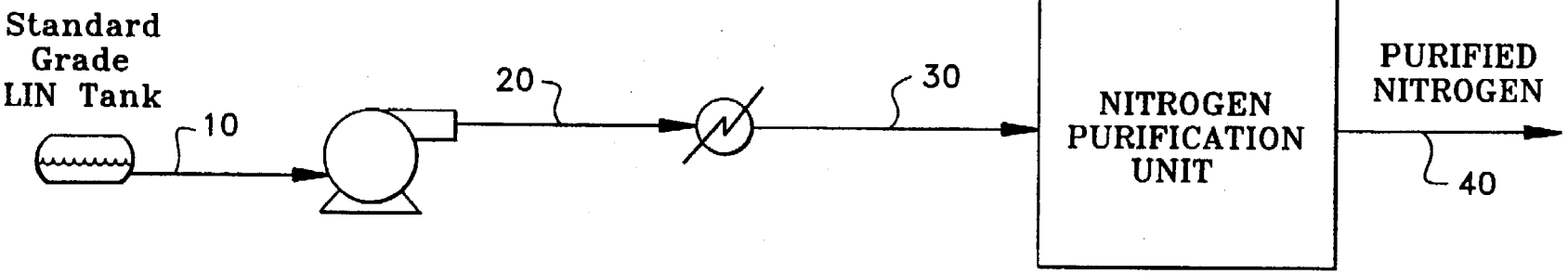
FIG. 2 (PRIOR ART)
FIG. 2 is a general schematic diagram of a known ambient liquid nitrogen vaporizer/purification process.

Generally, in the high purity liquid oxygen unit 52 (as shown in detail in FIGS. 4–9), high pressure gaseous nitrogen stream in line 9 is condensed in at least one bottom reboiler/condenser to provide the necessary heat to the distillation columns of the unit. By giving off heat in the bottom reboiler/condenser(s), the high pressure gaseous nitrogen condenses. The condensed nitrogen is then reduced in pressure and delivered to at least one top reboiler/condenser to provide the necessary condensing duty to the distillation columns of high purity liquid oxygen unit 52. Any needed reflux to the distillation columns is generated by the liquid nitrogen delivered to the top reboiler/condenser (s). By taking on heat in the top reboiler/condenser(s), the liquid nitrogen vaporizes to form a reduced pressure gaseous nitrogen stream in line 17. The pressure of the distillation column is adjusted such that the vaporized nitrogen stream in line 17 is at a pressure which is slightly higher than the pressure of the purified nitrogen in line 40 exiting nitrogen purification unit 54. In particular, the pressure of vaporized nitrogen in line 17 leaving high purity liquid oxygen unit 52 would be the same as stream in line 30 of FIG. 2. Because the entire stream of vaporized nitrogen is sent directly to nitrogen purification unit 54 (as shown in FIG. 3), the process of the present invention does not use any recycled nitrogen and therefore does not require the associated compressor or heat exchanger.

Figure 4:
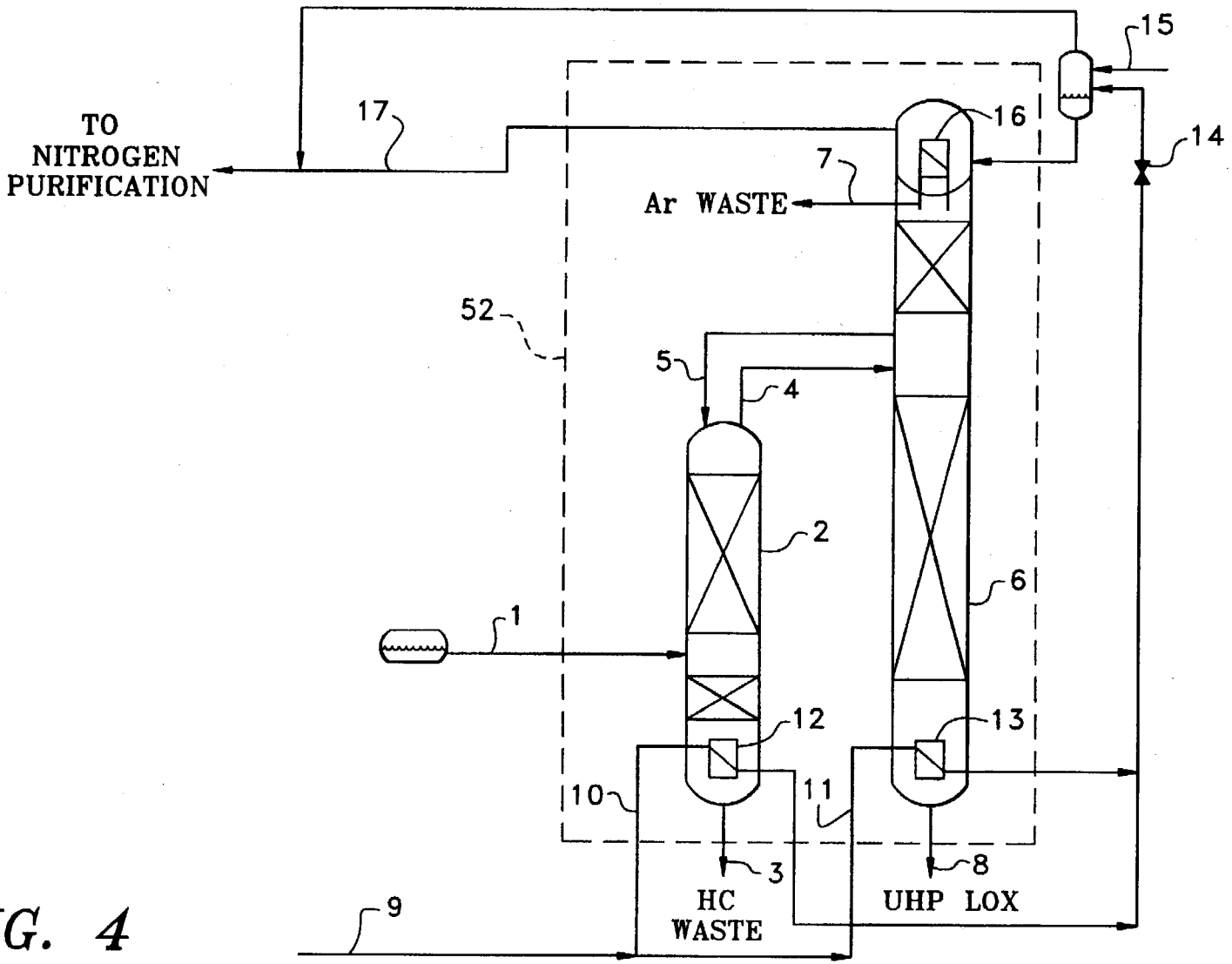
FIG. 4 is a schematic diagram of a first embodiment of the present invention, showing the configuration of the high purity liquid oxygen unit.

Turning to the specifics of high purity liquid oxygen unit 52 as shown in FIG. 4, this embodiment includes a distillation column with a side stripper. Specifically, standard grade liquid oxygen is introduced as feed in line 1 to a first distillation column 2 (i.e., a stripper), where the feed liquid oxygen is separated into a hydrocarbon-enriched waste stream 3 and a top vapor stream containing argon and oxygen in line 4. Stream in line 4 is substantially free of hydrocarbons. Top vapor stream in line 4 is then introduced to a second distillation column 6, where it is separated into an argon-enriched waste stream in line 7 and ultra high purity liquid oxygen in line 8, which is withdrawn from second distillation column 6 as a bottom product. In the embodiment shown in FIG. 4, reflux is provided into first distillation column 2 by withdrawing a liquid side product in line 5 from second distillation column 6 and introducing the liquid side product into the top of first distillation column 2.

Pressurized nitrogen vapor in line 9 is divided into two streams in 10 and 11, which are condensed in bottom reboiler/condensers 12 and 13, respectively. These streams provide the necessary heat to distillation columns 2 and 6. The nitrogen condensate streams are consolidated to form a single stream which is decreased in pressure across an isenthalpic Joule-Thompson (JT) valve 14 and used, together with any supplemental liquid nitrogen introduced in line 15, as a cooling medium in a top reboiler/condenser 16 located at the top of distillation column 6. Reduced pressure gaseous nitrogen stream in line 17 is then purified in nitrogen purification unit 54, as shown in FIG. 3. If needed, refrigeration from nitrogen stream in line 17 can be recovered in appropriate heat exchangers. The refrigeration from liquid nitrogen in the top reboiler/condenser 16 serves to condense argon-enriched overhead vapor from column 6 to provide the reflux necessary for separation. Waste stream in line 7 is preferably withdrawn as a vapor to save refrigeration. Although the top and bottom reboiler/condensers are shown in all of the figures as being contained within the respective columns, the reboiler/condensers only need be associated with the columns, either by being contained therein or situated near the columns. By being associated with the columns, the reboilers/condensers are in fluid communication with the columns.

Figure 5:
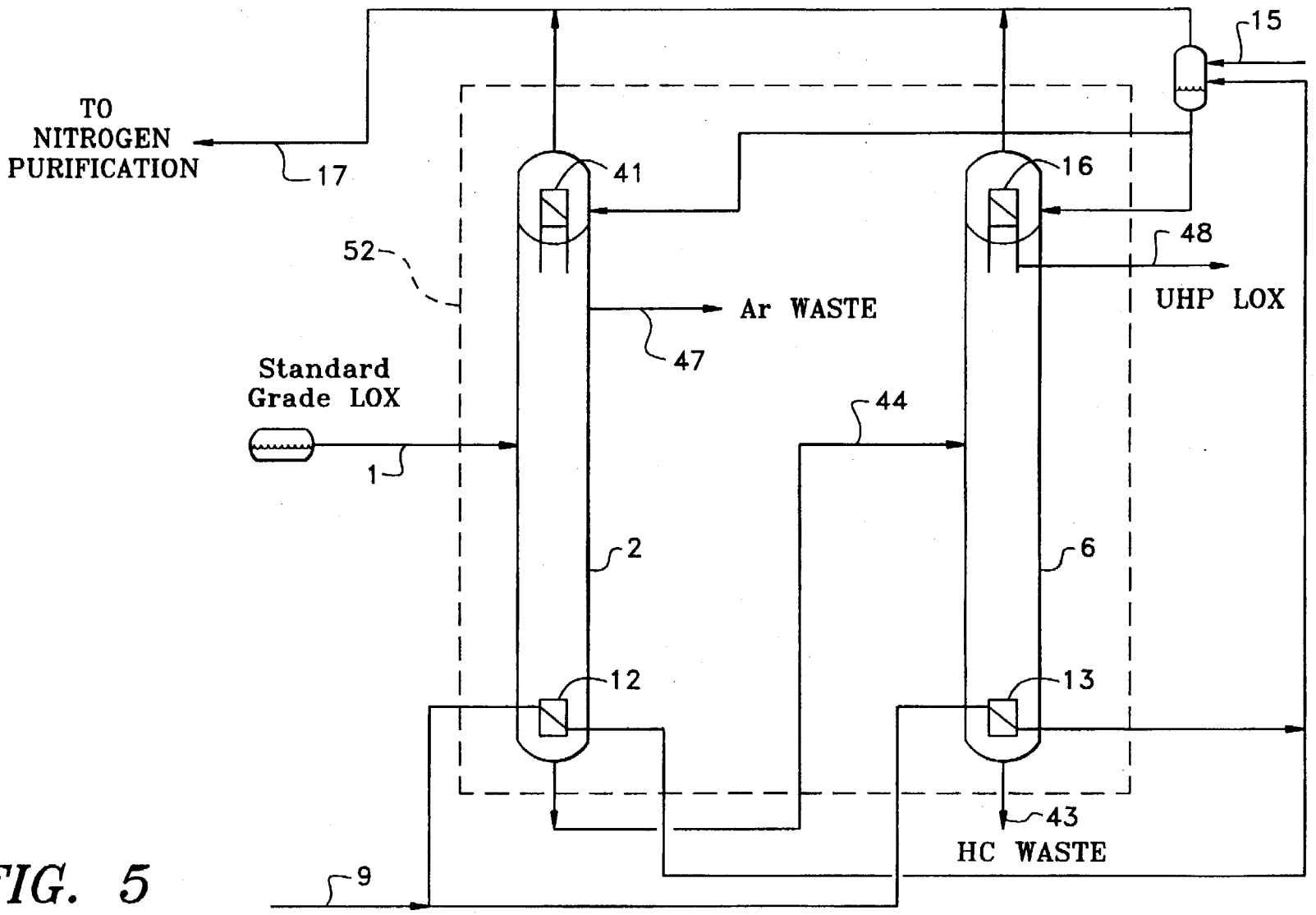
FIG. 5 is a schematic diagram of a second embodiment of the present invention, showing the configuration of the high purity liquid oxygen unit.

Other examples of different distillation configurations of the high purity liquid oxygen unit 52 for separating the ternary mixture of oxygen, argon, and hydrocarbons are shown in FIGS. 5–9. In FIG. 5, standard grade liquid oxygen in line 1 is separated in the "direct sequence" of distillation columns. According to the direct sequence of distillation columns, the most volatile component, argon, is removed as an argon-enriched waste stream in line 47 as a top product in the first distillation column 2. The bottom product of first column 2 in line 44 (i.e., a bottom stream containing hydrocarbons and oxygen) is then introduced to a second distillation column 6. In distillation column 6, the bottom stream containing hydrocarbons and oxygen is separated into ultra high purity gaseous oxygen and a hydrocarbon-enriched waste stream in line 43. As in the embodiment shown in FIG. 4, two bottom reboiler/condensers 12 and 13 are used. In this case, however, two top reboiler/condensers 16 and 41 are used to provide the necessary reflux to each column. Also, top reboiler/condenser 16 associated with second distillation column 6 serves to condense the high purity gaseous oxygen to form ultra high purity liquid oxygen in line 48.

Figure 6:
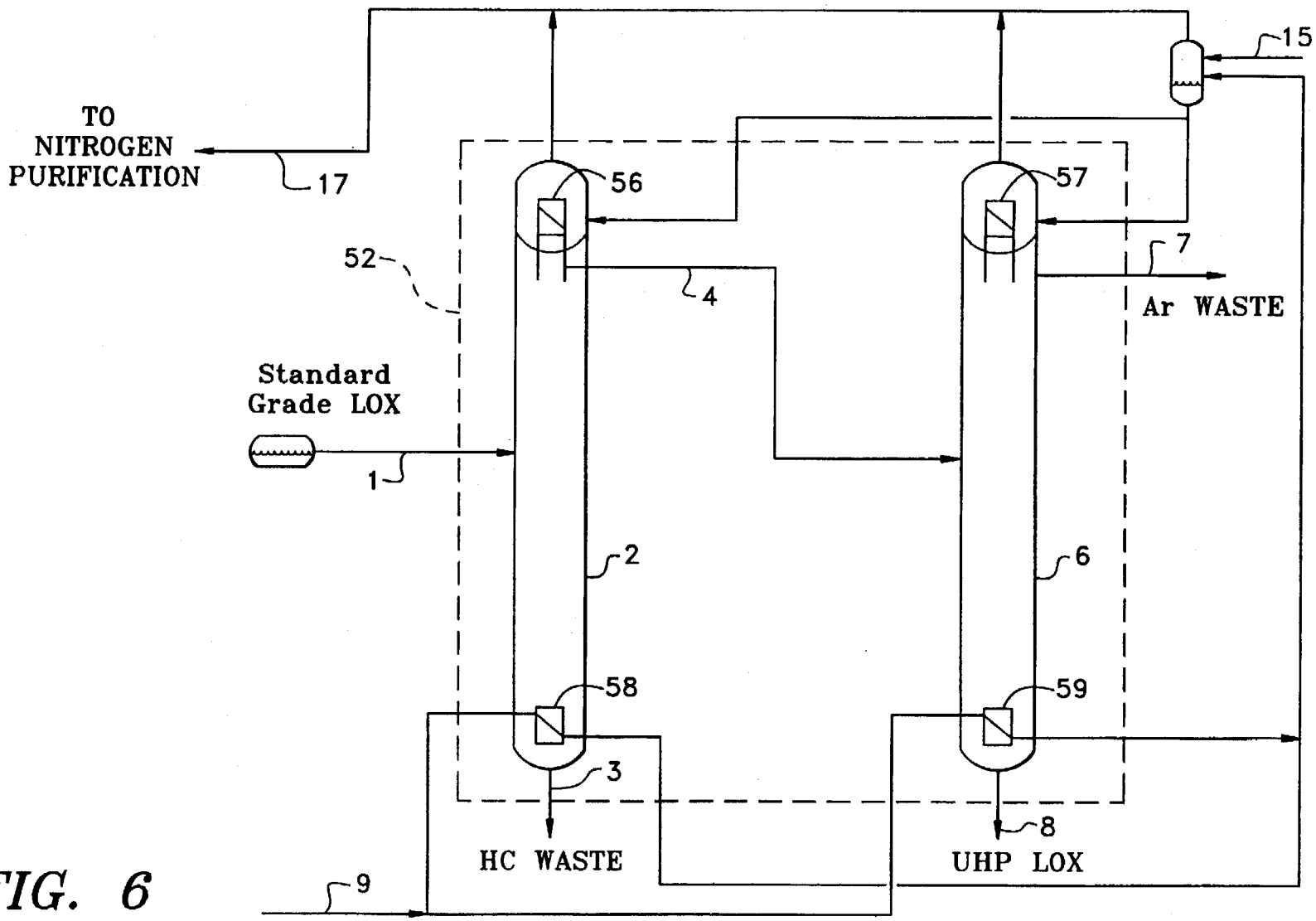
FIG. 6 is a schematic diagram of a third embodiment of the present invention, showing the configuration of the high purity liquid oxygen unit.

In FIG. 6, standard grade liquid oxygen in line 1 is separated in the "indirect sequence" of distillation columns, in which hydrocarbons are first removed as a bottom product in line 3 of first distillation column 2. The top product of first distillation column 2 is a top vapor stream containing argon and oxygen. In this system, each distillation column 2 and 6 has its own bottom reboiler/condenser 58 and 59 and its own top reboiler/condenser 56 and 57 for providing necessary reflux to each column. Specifically, the top vapor stream containing argon and oxygen in first distillation column 2 is condensed in top reboiler/condenser 56 with a portion of the condensed top stream returning as reflux to first distillation column 2. The remaining portion is delivered to second distillation column 6 via line 4. There, the distillate is separated into ultra high purity liquid oxygen and an argon-enriched top vapor. A portion of the argon-enriched top vapor is withdrawn as argon-enriched waste stream in line 7, and another portion is condensed in the top reboiler/condenser 57 of distillation column 6 to be returned as reflux to second distillation column 6. Ultra high purity liquid oxygen is withdrawn in line 8 as a bottom product from second distillation column 6.

Figure 7:
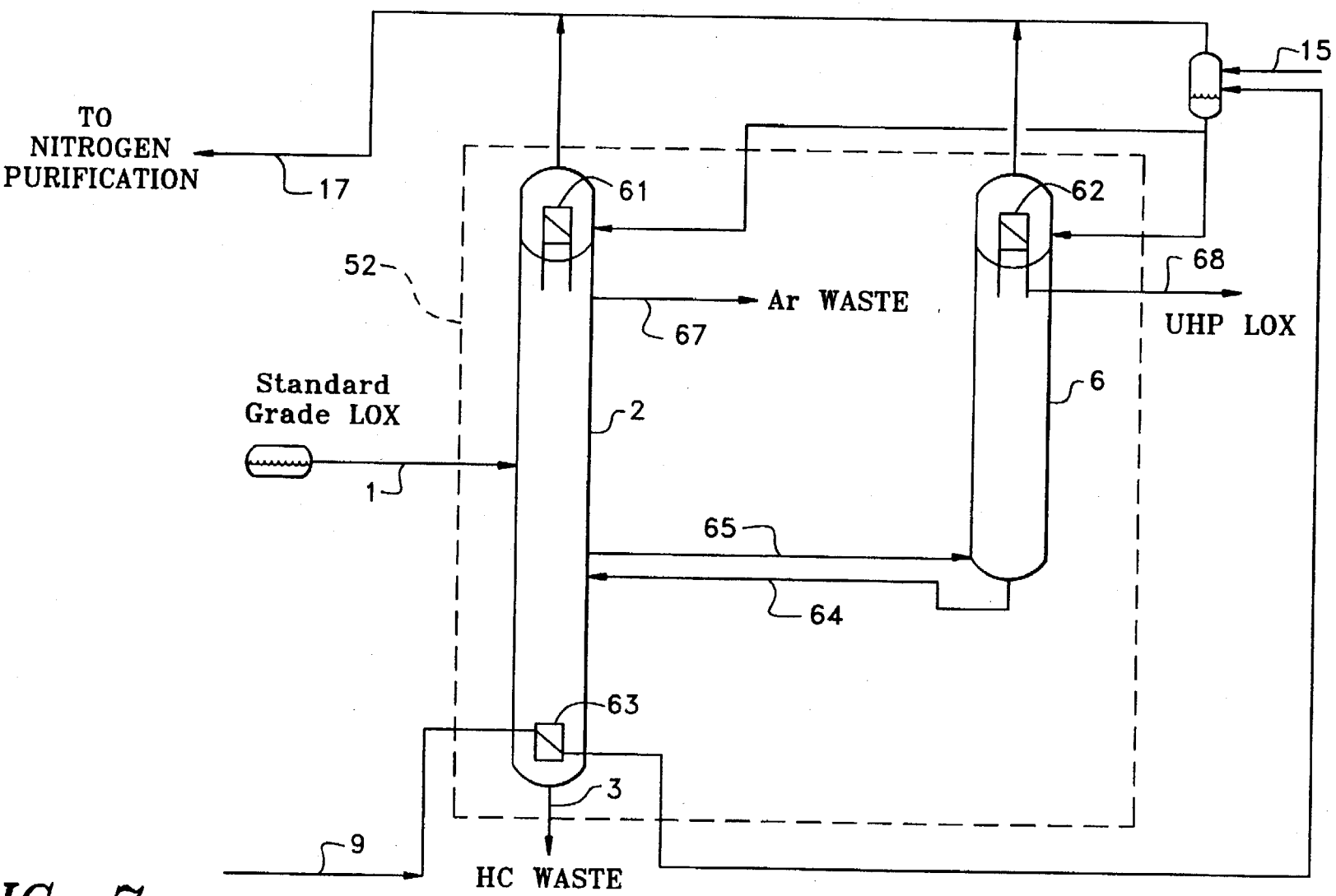
FIG. 7 is a schematic diagram of a fourth embodiment of the present invention, showing the configuration of the high purity liquid oxygen unit.

In the embodiment shown in FIG. 7, a system with a side rectifier is used to separate standard grade liquid oxygen. Specifically, standard grade liquid oxygen in line 1 is introduced to a first distillation column 2 for separation into a hydrocarbon-enriched waste stream in line 3, a vapor stream, and a top argon-enriched waste stream. In this system, only first distillation column 2 requires a bottom reboiler/condenser 63. Vapor stream in line 65 is withdrawn from first distillation column 2 and introduced to second distillation column 6 for rectification into ultra high purity gaseous oxygen and side liquid stream 6. Side liquid stream 64 is returned to first distillation column 2 for a continued separation. Both distillation columns include a top reboiler/condenser 61 and 62, with the top reboiler/condenser 62 in distillation column 6 serving to condense ultra high purity gaseous oxygen into ultra high purity liquid oxygen, a portion of which is withdrawn in line 68 and a portion of which is returned as reflux to second distillation column 6. Top reboiler/condenser 61 serves to condense the argon-enriched waste stream to provide reflux to first distillation column 2. An argon-enriched waste stream in line 67 can be withdrawn either as a vapor or a liquid, but preferably as a vapor to conserve refrigeration.

Figure 8:
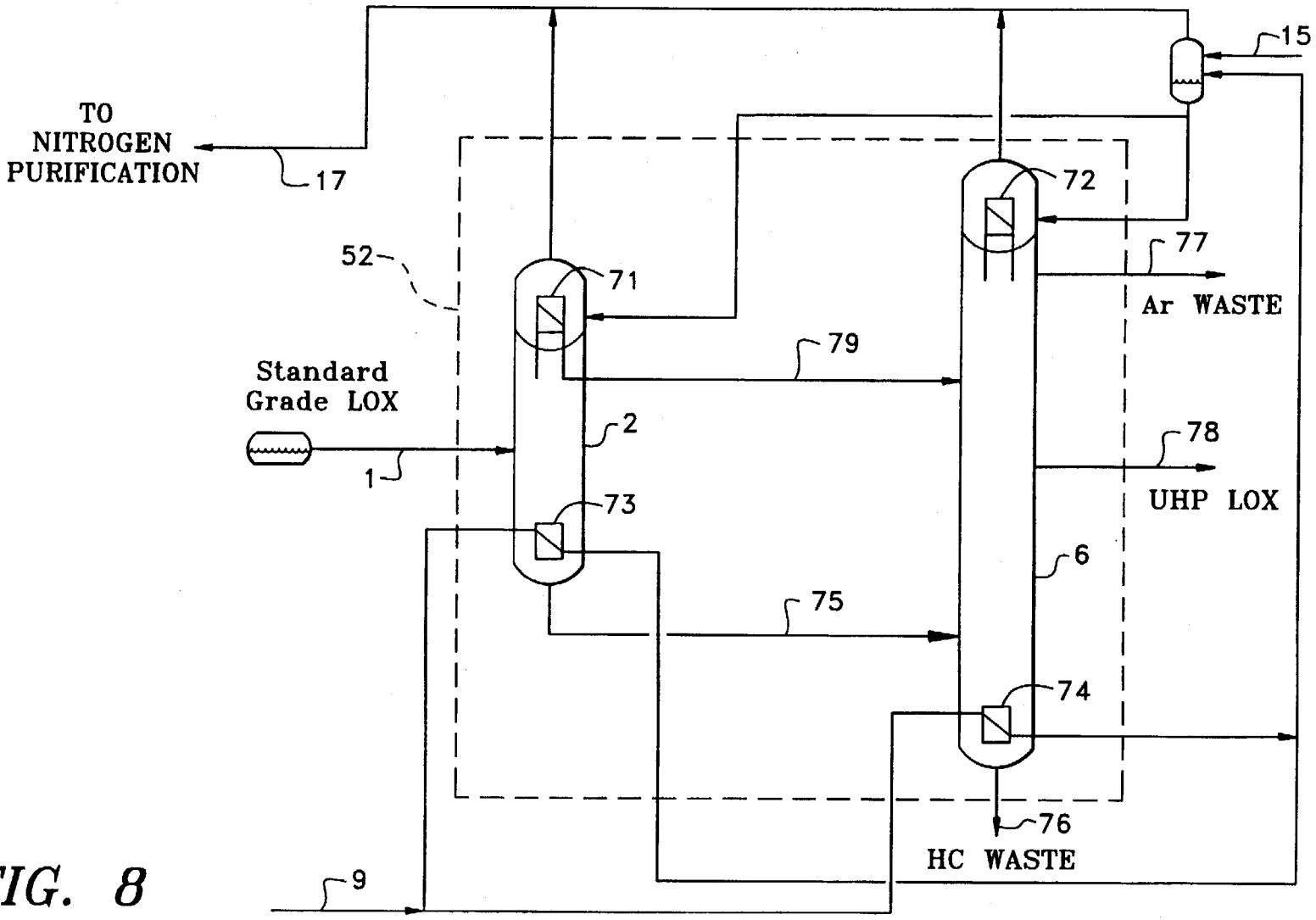
FIG. 8 is a schematic diagram of a fifth embodiment of the present invention, showing the configuration of the high purity liquid oxygen unit.

In FIG. 8, the ternary mixture of argon, oxygen, and hydrocarbons in standard grade liquid oxygen in line 1 is initially prefractionated in first distillation column 2. This step causes the ternary mixture to separate into two binary mixtures: A top stream containing argon and oxygen and a bottom stream containing hydrocarbons and oxygen. The top stream containing argon and oxygen is condensed in a top reboiler/condenser 71 and a portion is returned to first distillation column 2 as reflux. The remaining portion is fed via line 79, along with bottom stream containing hydrocarbons and oxygen withdrawn in line 75, into second distillation column 6 in two locations. Specifically, stream in line 79 is introduced at a location above stream in line 75. Second column 6 produces an argon-enriched overhead vapor, ultra high purity liquid oxygen as a side product withdrawn in line 78, and a hydrocarbon-enriched waste stream withdrawn as a bottom product in line 76. A portion of the argon-enriched overhead vapor is withdrawn as a waste stream in line 77, and another portion is condensed in a second top reboiler/condenser 72 and returned as reflux to second distillation column 6. In the embodiment shown in FIG. 8, each distillation column also includes its own bottom reboiler/condenser 73 and 74.

Figure 9:
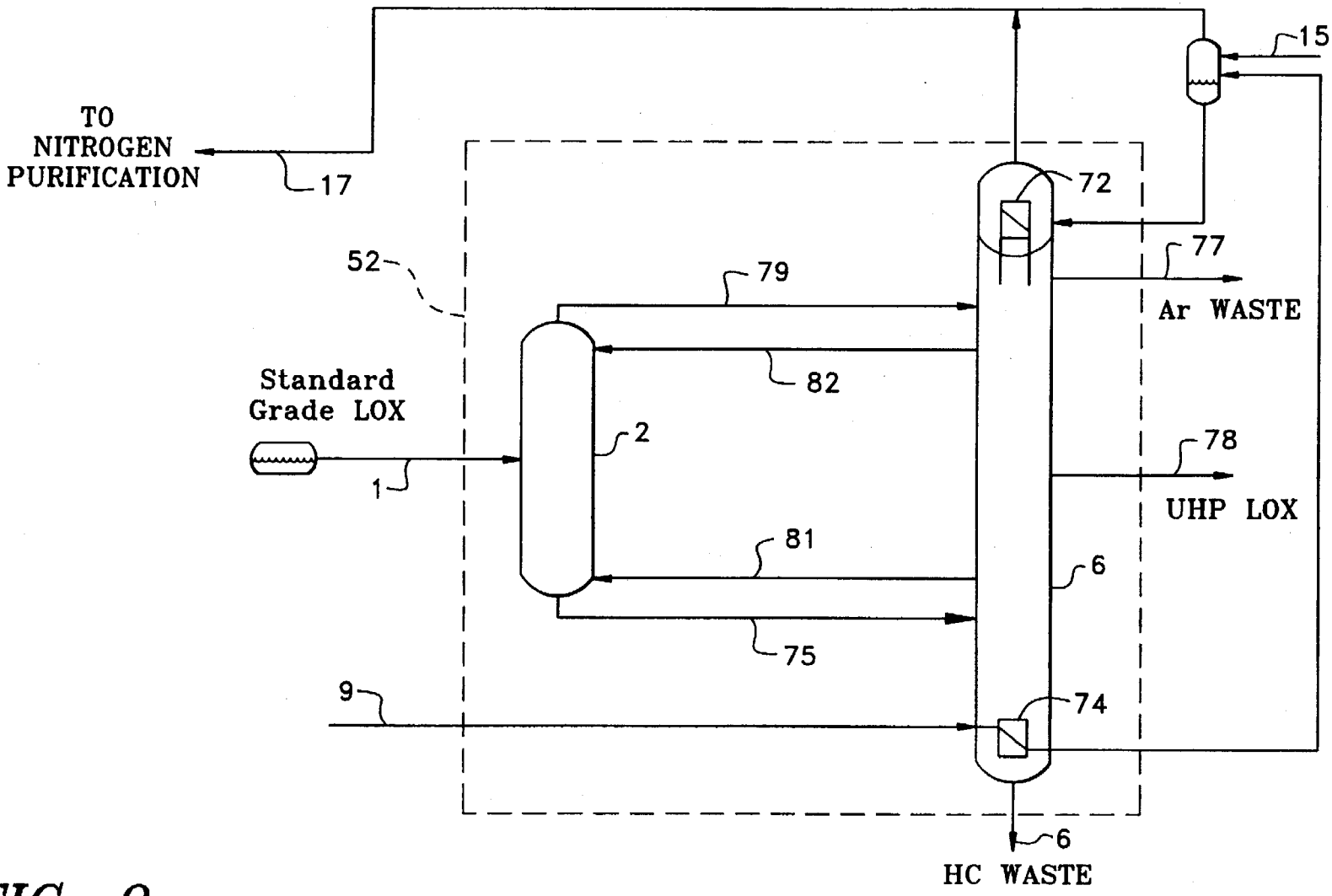
FIG. 9 is a schematic diagram of a sixth embodiment of the present invention, showing the configuration of the high purity liquid oxygen unit.

The system of FIG. 9 is very similar to the system shown in FIG. 8 except that first distillation column 2 does not have a bottom reboiler/condenser or a top reboiler/condenser. Instead, the reboil and reflux ratios of first distillation column 2 are controlled by a vapor side stream in line 81 which is withdrawn from second distillation column 6 and introduced to first distillation column 2 near its bottom, and a liquid side stream in line 82 which is withdrawn from second distillation column 6 and introduced to first distillation column 2 near its top.

In all of the embodiments shown in FIG. 4–9, the components of the high purity liquid oxygen unit 52 are integrated with a nitrogen purification unit 54 in that high pressure nitrogen vapor is introduced to unit 52 in line 9 and withdrawn from unit 52 in line 17 to nitrogen purification unit 54. Supplemental liquid nitrogen can be provided in line 15 to supply additional refrigeration to high purity liquid oxygen unit 52.

Generally, the desired pressure of purified nitrogen is in the range of 50 psia to 150 psia. This pressure sets the pressure of stream in line 17 in FIG. 3. Therefore, the pressure of the distillation columns is set by the pressure of the vaporizing nitrogen to maintain proper temperature differences between the condensing and boiling liquids. Consequently, the pressure of entering liquid and nitrogen vapor to the high purity liquid oxygen unit 52 is determined from the above conditions. Specifically, the liquid nitrogen must be pressurized to a pressure sufficient to drive (i.e., provide sufficient boilup and condensing duties to) the high purity liquid oxygen unit.

EXAMPLE

In order to demonstrate the efficacy of the present invention and to compare the present invention to a conventional process, the following example was developed. In Table 1 below, the stream parameters are listed for the embodiment shown in FIG. 4. The basis of the simulations is a feed of 1.000 lb-mole/hour of standard grade liquid oxygen in line 1. In the simulations, the number of theoretical trays in distillation column 2 was 22, and the number of theoretical trays in distillation column 6 was 96. The pressure of gaseous nitrogen to be sent to a nitrogen purifier unit is taken to be about 54 psia.

TABLE 1

| Stream Number | Flow lb-mole/h | Temperature deg F. | Pressure psia | Ar mole fraction | $O_2$ mole fraction | HC mole fraction | $N_2$ mole fraction |
|---|---|---|---|---|---|---|---|
| 1 | 1.000 | −289 | 23.0 | .005 | .995 | 4E-5 | — |
| 3 | 0.125 | −289 | 23.2 | .00088 | .9988 | .00032 | — |
| 4 | 1.750 | −290 | 21.7 | .0037 | .9963 | — | — |
| 5 | 0.875 | −290 | 21.7 | .0018 | .9982 | — | — |
| 7 | 0.010 | −295 | 20.0 | .4938 | .5062 | — | — |
| 8 | 0.865 | −286 | 26.6 | — | 1.0000 | — | — |
| 9 | 7.527 | −284 | 95.5 | .00011 | 1.0E-6 | — | .99989 |
| 10 | 2.490 | −284 | 95.0 | .00011 | 1.0E-6 | — | .99989 |
| 11 | 5.037 | −284 | 95.0 | .00011 | 1.0E-6 | — | .99989 |
| 15 | 0.115 | −296 | 55.0 | .00011 | 1.0E-6 | — | .99989 |
| 17 | 7.642 | −297 | 54.0 | .00011 | 1.0E-6 | — | .99989 |

Figure 1:
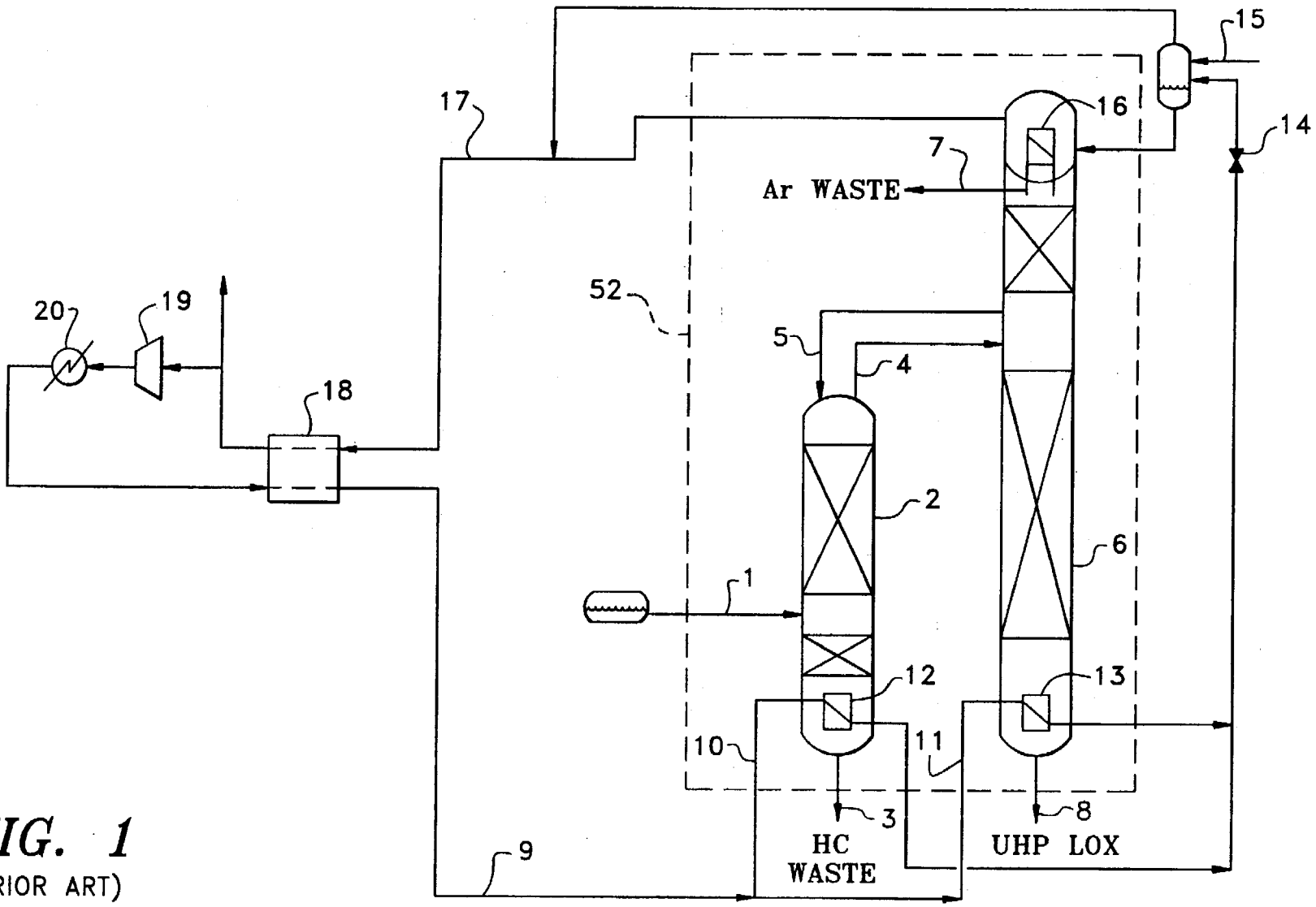
FIG. 1 (PRIOR ART)
FIG. 1 is a schematic diagram of a prior art process, showing the configuration of the high purity liquid oxygen unit.

If the process of FIG. 1 were used to provide gaseous nitrogen for a nitrogen purification unit, the recycled nitrogen would have to be compressed from about 50 psia to 100 psia (allowing for pressure drops in the recycle heat exchanger). According to the present invention, however, this energy consumption is eliminated by vaporizing liquid nitrogen in a vaporizer to a higher pressure of about 95 psia rather than 54 psia, which would be required if the nitrogen were to be applied directly to a nitrogen purifier.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

We claim:

1. A method of producing ultra high purity liquid oxygen from standard grade liquid oxygen comprising the steps of:

pressurizing a source of liquid nitrogen;

vaporizing at least a portion of said liquid nitrogen to form a high pressure gaseous nitrogen stream;

introducing said standard grade liquid oxygen to a high purity liquid oxygen unit for purifying said standard grade liquid oxygen into said ultra high purity liquid oxygen;

introducing said high pressure gaseous nitrogen stream to at least one bottom reboiler/condenser of said high purity liquid oxygen unit for providing heat to said high purity liquid oxygen unit and to form a nitrogen condensate stream;

introducing said nitrogen condensate stream to at least one top reboiler/condenser of said high purity liquid oxygen unit for providing refrigeration to said high purity liquid oxygen unit and to form a reduced pressure gaseous nitrogen stream;

introducing said reduced pressure gaseous nitrogen stream to a nitrogen purification unit; and withdrawing from said high purity liquid oxygen unit: (a) said ultra high purity liquid oxygen; (b) an argon-enriched waste stream; and (c) a hydrocarbon-enriched waste stream.

2. The method of claim 1, wherein the step of vaporizing at least a portion of said liquid nitrogen to form a high pressure gaseous nitrogen stream comprises vaporizing a first portion of said liquid nitrogen; and said method further comprises combining the remaining portion of said liquid nitrogen with said nitrogen condensate stream to form a combined stream and introducing said combined stream to said at least one top reboiler/condenser of said high purity liquid oxygen unit.

3. The method of claim 1, wherein the step of introducing said standard grade liquid oxygen to said high purity liquid oxygen unit for purifying said standard grade liquid oxygen into said ultra high purity liquid oxygen comprises:

introducing said standard grade liquid oxygen to a first distillation column for separation into said hydrocarbon-enriched waste stream and a top vapor stream containing argon and oxygen; and introducing said top vapor stream to a second distillation column for separation into an argon-enriched vapor overhead and said ultra high purity liquid oxygen as a bottom product.

4. The method of claim 3, wherein:

a first of said at least one top reboiler/condenser of said high purity liquid oxygen unit is associated with said second distillation column; and the step of introducing said standard grade liquid oxygen to said high purity liquid oxygen unit for purifying said standard grade liquid oxygen into said ultra high purity liquid oxygen further comprises:

(a) condensing a portion of said argon-enriched vapor overhead in said first top reboiler/condenser and returning said portion of said condensed argon-enriched waste stream as reflux to said second distillation column;

(b) withdrawing the remaining portion of said argon-enriched vapor overhead as said argon-enriched waste stream; and (c) withdrawing a liquid side product stream from said second distillation column and introducing said liquid side product stream to said first distillation column as reflux.

5. The method of claim 3, wherein:

a first of said at least one top reboiler/condenser of said high purity liquid oxygen unit is associated with said first distillation column;

a second of said at least one top reboiler/condenser of said high purity liquid oxygen unit is associated with said second distillation column;

the step of introducing said standard grade liquid oxygen to said high purity liquid oxygen unit for purifying said standard grade liquid oxygen into said ultra high purity liquid oxygen further comprises:

(a) condensing said top vapor stream containing argon and oxygen in said first top reboiler/condenser and returning a portion of said condensed top vapor stream containing argon and oxygen as reflux to said first distillation column; and (b) condensing a portion of said argon-enriched vapor overhead in said second top reboiler/condenser and returning said portion of said condensed argon-enriched waste stream as reflux to said second distillation column; and (c) withdrawing the remaining portion of said argon-enriched vapor overhead as said argon-enriched waste stream.

6. The method of claim 1, wherein the step of introducing said standard grade liquid oxygen to said high purity liquid oxygen unit for purifying said standard grade liquid oxygen into said ultra high purity liquid oxygen comprises:

introducing said standard grade liquid oxygen to a first distillation column for separation into said argon-enriched waste stream and a bottom stream containing hydrocarbons and oxygen; and introducing said bottom stream containing hydrocarbons and oxygen to a second distillation column for separation into said ultra high purity liquid oxygen and said hydrocarbon-enriched waste stream.

7. The method of claim 1, wherein:

the step of introducing said standard grade liquid oxygen to said high purity liquid oxygen unit for purifying said standard grade liquid oxygen into said ultra high purity liquid oxygen comprises:

(a) introducing said standard grade liquid oxygen to a first distillation column for separation into said hydrocarbon-enriched waste stream and said argon-enriched waste stream;

(b) withdrawing a vapor stream from said first distillation column;

(c) introducing said vapor stream to a second distillation column for rectification into ultra high purity gaseous oxygen and a side liquid stream; and (d) introducing said side liquid stream to said first distillation column;

a first of said at least one top reboiler/condenser of said high purity liquid oxygen unit is associated with said second distillation column; and the step of introducing said nitrogen condensate stream to at least one top reboiler/condenser of said high purity liquid oxygen unit comprises introducing said nitrogen condensate stream to said first top reboiler/condenser for condensing said ultra high purity gaseous oxygen to form said ultra high purity liquid oxygen.

8. The method of claim 1, wherein the step of introducing said standard grade liquid oxygen to said high purity liquid oxygen unit for purifying said standard grade liquid oxygen into said ultra high purity liquid oxygen comprises:

introducing said standard grade liquid oxygen to a first distillation column for separation into a top stream containing argon and oxygen and a bottom stream containing hydrocarbons and oxygen; and introducing said top stream and said bottom stream to a second distillation column for separation into said argon-enriched waste stream as a top product, said ultra high purity liquid oxygen as a side product, and said hydrocarbon-enriched waste stream as a bottom product.

9. The method of claim 8, wherein:

a first of said at least one top reboiler/condenser of said high purity liquid oxygen unit is associated with said first distillation column;

a second of said at least one top reboiler/condenser of said high purity liquid oxygen unit is associated with said second distillation column; and the step of introducing said standard grade liquid oxygen to said high purity liquid oxygen unit for purifying said standard grade liquid oxygen into said ultra high purity liquid oxygen further comprises:

(a) condensing said top stream containing argon and oxygen in said first top reboiler/condenser and returning a portion of said condensed top stream as reflux to said first distillation column;

(b) condensing a portion of said argon-enriched vapor overhead in said second top reboiler/condenser and returning said portion of said condensed argon-enriched waste stream as reflux to said second distillation column; and (c) withdrawing the remaining portion of said argon-enriched vapor overhead as said argon-enriched waste stream.

10. The method of claim 8, wherein:

a first of said at least one top reboiler/condenser of said high purity liquid oxygen unit is associated with said second distillation column; and the step of introducing said standard grade liquid oxygen to said high purity liquid oxygen unit for purifying said standard grade liquid oxygen into said ultra high purity liquid oxygen further comprises:

(a) condensing a portion of said argon-enriched vapor overhead in said first top reboiler/condenser and returning said portion of said condensed argon-enriched waste stream as reflux to said second distillation column;

(b) withdrawing the remaining portion of said argon-enriched vapor overhead as said argon-enriched waste stream;

(c) withdrawing a liquid side stream from said second distillation column and introducing said liquid side stream to said first distillation column; and (d) withdrawing a vapor side stream from said second distillation column and introducing said vapor side stream to said first distillation column.

11. The method of claim 1, wherein the step of pressurizing said source of liquid nitrogen comprises pressurizing said source of liquid nitrogen to a pressure sufficient to drive said high purity liquid oxygen unit.

12. A method of producing ultra high purity liquid oxygen from standard grade liquid oxygen comprising the steps of:

(a) introducing said standard grade liquid oxygen to a high purity liquid oxygen unit for purifying said standard grade liquid oxygen into said ultra high purity liquid oxygen; (b) introducing a high pressure gaseous nitrogen stream to at least one bottom reboiler/condenser of said high purity liquid oxygen unit for providing heat to said high purity liquid oxygen unit and to form a nitrogen condensate stream; (c) introducing said nitrogen condensate stream to at least one top reboiler/condenser of said high purity liquid oxygen unit for providing refrigeration to said high purity liquid oxygen unit and to form a reduced pressure gaseous nitrogen stream; and (d) withdrawing from said high purity liquid oxygen unit: (i) said ultra high purity liquid oxygen; (ii) an argon-enriched waste stream; and (iii) a hydrocarbon-enriched waste stream, characterized in that said method is integrated with a nitrogen purification process by: (f) providing said high pressure gaseous nitrogen stream by the steps of pressurizing a source of liquid nitrogen and vaporizing at least a portion of said liquid nitrogen to form said high pressure gaseous nitrogen stream; and (g) introducing said reduced pressure gaseous nitrogen stream to a nitrogen purification unit.

* * * * *